US009695025B2

(12) United States Patent
Sawodny et al.

(10) Patent No.: US 9,695,025 B2
(45) Date of Patent: Jul. 4, 2017

(54) METHOD FOR CONTROLLING AN AERIAL APPARATUS, AND AERIAL APPARATUS WITH CONTROLLER IMPLEMENTING THIS METHOD

(71) Applicant: IVECO MAGIRUS AG, Ulm (DE)

(72) Inventors: Oliver Sawodny, Stuttgart (DE); Alexander Pertsch, Stuttgart (DE)

(73) Assignee: IVECO MAGIRUS AG, Ulm (DE)

( * ) Notice: Subject to any disclaimer, the term of this patent is extended or adjusted under 35 U.S.C. 154(b) by 63 days.

(21) Appl. No.: 14/971,605

(22) Filed: Dec. 16, 2015

(65) Prior Publication Data

US 2016/0176692 A1 Jun. 23, 2016

(30) Foreign Application Priority Data

Dec. 18, 2014 (EP) ..... 14199073

(51) Int. Cl.
*B66C 13/46* (2006.01)
*B66F 17/00* (2006.01)
(Continued)

(52) U.S. Cl.
CPC ..... *B66F 17/006* (2013.01); *A62C 27/00* (2013.01); *B66C 13/066* (2013.01);
(Continued)

(58) Field of Classification Search
CPC ... A62C 27/00; E06C 5/32; E06C 5/18; B66F 17/00
(Continued)

(56) References Cited

U.S. PATENT DOCUMENTS 4,131,914 A * 12/1978 Bricmont ..... C10B 45/00 348/208.99
6,062,650 A * 5/2000 Smith ..... E21C 35/24 299/1.4
(Continued)

FOREIGN PATENT DOCUMENTS

EP 1772588 B1 6/2013
EP 2022749 B1 6/2014

OTHER PUBLICATIONS

European Search Report for EP Application No. 14 19 9073 mailed Jun. 22, 2015, 4 pages.
(Continued)

*Primary Examiner* — Thomas G Black
*Assistant Examiner* — Wae Louie
(74) *Attorney, Agent, or Firm* — Remarck Law Group PLC

(57) ABSTRACT

A method for controlling an aerial apparatus with a telescopic boom, strain gauge sensors for detecting the bending state of the telescopic boom in horizontal and vertical directions, a gyroscope attached to the top of the telescopic boom and a control arrangement for controlling movement of the aerial apparatus on the basis of signal values gained from the sensors and the gyroscope, the method including the following steps: obtaining raw signals from the sensors and the gyroscope, calculating reference signals from the raw signals, reconstructing a first oscillation mode and a second oscillation mode from the reference signals and additional model parameters related to construction of the aerial apparatus, calculating a compensation angular velocity value from the reconstructed oscillation modes, and adding the calculated compensation angular velocity value to a feedforward angular velocity value to result in a drive control signal.

12 Claims, 6 Drawing Sheets

(51) Int. Cl.

| | |
|---|---|
| ***A62C 27/00*** | (2006.01) |
| ***B66C 13/06*** | (2006.01) |
| ***B66F 11/04*** | (2006.01) |
| ***E06C 5/04*** | (2006.01) |
| ***E06C 5/36*** | (2006.01) |

(52) U.S. Cl.
CPC ..... *B66F 11/046* (2013.01); *E06C 5/04* (2013.01); *E06C 5/36* (2013.01)

(58) Field of Classification Search
USPC ..... 701/49, 50; 182/17, 19; 280/4; 414/685
See application file for complete search history.

(56) References Cited

U.S. PATENT DOCUMENTS

| | | | | |
|---|---|---|---|---|
| 9,067,768 | B1 * | 6/2015 | Johnson | F21V 33/00 |
| 9,260,916 | B1 * | 2/2016 | Brotherton | E06C 5/02 |
| 9,302,129 | B1 * | 4/2016 | Betz | A62C 27/00 |
| 2008/0060822 | A1 * | 3/2008 | Salmi | A62C 27/00 169/24 |
| 2011/0042164 | A1 * | 2/2011 | Clark | B66F 17/006 182/2.2 |
| 2012/0308354 | A1 * | 12/2012 | Tafazoli Bilandi | B66C 13/46 414/685 |
| 2014/0116975 | A1 * | 5/2014 | Benton | B66C 23/88 212/302 |
| 2014/0305738 | A1 * | 10/2014 | Lauterjung | E06C 5/04 182/19 |
| 2015/0120152 | A1 * | 4/2015 | Lauterjung | E06C 5/18 701/49 |
| 2015/0273252 | A1 * | 10/2015 | Lenz, Jr. | A62C 27/00 182/17 |
| 2015/0273253 | A1 * | 10/2015 | Lenz, Jr. | A62C 27/00 280/4 |
| 2015/0273255 | A1 * | 10/2015 | Lenz, Jr. | E06C 5/04 280/4 |
| 2016/0145940 | A1 * | 5/2016 | Aiken | E06C 5/04 280/4 |
| 2016/0176692 | A1 * | 6/2016 | Sawodny | B66F 17/006 701/50 |

OTHER PUBLICATIONS

Zimmert, N.; Pertsch, A.; Sawodny, O.: "2-DOF Control of a Fire-Rescue Turntable Ladder", IEEE Transactions On Control Systems Technology, vol. 20, No. 2, Mar. 2012 (Mar. 2012), pp. 438-452, XP002741228.

* cited by examiner

METHOD FOR CONTROLLING AN AERIAL APPARATUS, AND AERIAL APPARATUS WITH CONTROLLER IMPLEMENTING THIS METHOD

CROSS REFERENCE TO RELATED APPLICATIONS

This application claims priority to European Patent Application No. 14199073.9 filed on Dec. 18, 2014, the entire disclosure of which is incorporated herein by reference.

The present invention refers to a method controlling an aerial apparatus, and to an aerial apparatus comprising a controller implementing this control method.

BACKGROUND OF THE INVENTION

An aerial apparatus of this kind is, for example, a turntable ladder with a bendable articulated arm that is attached to the upper end of a telescopic boom. However, the invention is not limited to fire fighting ladders as such, but also includes similar systems such as articulated or telescopic platforms and aerial rescue equipment. These systems are, in general, mounted on a vehicle such that they are rotatable and erectable.

For example, according to document DE 94 16 367 U1, the articulated arm is attached to the top end of the uppermost element of the telescopic boom and protrudes from the fully retracted telescopic boom so that it can be pivoted at any time regardless of the current extraction length of the telescopic boom. Another example of a ladder with an articulated arm which can be telescopic for itself is disclosed by EP 1 726 773 B1. In still another alternative design, the articulated arm is included in the uppermost element of the telescopic boom so that it can be fully retracted into the telescopic boom, but pivoted from a certain extraction length on up, as disclosed in EP 2 182 164 B1.

Moreover, control devices for turntable ladders, elevated platforms and the like are disclosed in EP 1138868 B1 and EP1138867 B1. A common problem that is discussed in these documents is the dampening of oscillations during the movement of the ladder. This problem is becoming even more important with increasing length of the ladder. It has therefore been proposed to attach sensors for detecting the present oscillation movement at different positions along the telescopic boom. For this purpose, strain gauge sensors are used, also called SG sensors in the following (with SG as abbreviation for "strain gauge"), and an additional two- or three-axis gyroscope attached within the upper part of the telescopic boom for measuring the angular velocity of the upper end of the ladder directly, preferably close to the pivot point of the articulated arm or to the tip of the ladder. A controller is provided for controlling the movement of the aerial apparatus on the basis of signal values that are gained from the SG sensors and the gyroscope. During operation, and especially when an input command for moving the aerial apparatus is passed to the controller, the present oscillation status is taken into account by means of processing the signal values, so that the movement of the ladder can be corrected such that the tip of the ladder reaches and maintains a target position despite the elastic flexibility of the boom.

Existing methods to actively dampen the oscillations of the boom of turntable ladders or similar apparatus are not suitable for and not applicable to relatively large articulated ladders, i.e. ladders with an articulated arm and a maximum reachable height of in particular more than 32 m. For these ladders, due to the length of their boom in relation to their cross section, the spatial distribution of the material must be considered, so that lumped-parameter models based on lumped-mass approximations are not suitable to adequately describe the elastic oscillations of such ladders. Also, not only the fundamental oscillation, but also the second harmonic (and possibly higher harmonics) needs to be actively damped, and the influences of the articulated arm and in particular of changes of the pivot angle need to be considered. Also, other than for ladders up to 32 m, the elastic bending in the horizontal direction and torsion cannot be assumed as independent from each other. Instead, all oscillation modes associated with rotations of the turntable consist of coupled bending and torsional deflections, as will be explained in detail below.

Methods for active oscillation damping and trajectory tracking that consider the fundamental bending oscillations for each the elevation and rotation axis only are known from EP 1138868 B1 and EP1138867 B1, which have already been cited above. These are only applicable to ladders without articulated arm and with a maximum height of up to 32 m, for which only the fundamental oscillation needs to be considered for each axis. An enhanced method for articulated ladders is known from EP 1 772 588 B1, where the flexible oscillations of an articulated ladder are approximated using a lumped-parameter model. The model consists of three point masses that are connected to each other via spring-damper elements. The model, and thus also the subsequently developed oscillation damping control, fail to acknowledge the spatially distributed nature of the boom, so that the coupling of horizontal bending and torsion is not included in the design. Also, higher harmonics are not actively damped, but rather are considered as disturbances, which are filtered using a disturbance observer. The method uses strain gauge (SG) sensors at the lower end of the boom or measurements of the hydraulic pressure of the actuators to detect oscillations. For larger articulated ladders, these measurements are not sufficiently sensitive to measure the second harmonic with adequate signal to noise ratio at all ladder lengths and positions of the articulated arm, which is especially necessary for the ladders considered in the present patent application.

An active oscillation damping that acknowledges the spatial extend of the boom is known from EP 2 022 749 B1. The bending of the boom is modeled using Euler-Bernoulli beam theory with constant parameters, and the rescue cage at the tip of the boom is modeled as rigid body, which yields special dynamic boundary conditions for the beam. Based on a modal approximation of the infinite-dimensional model, the first and second harmonic oscillation are reconstructed from the measurements of SG sensors at the lower end and inertial measurements at the upper end of the boom, e.g. a gyroscope that measures rotation rates of the same rotation axis. The oscillation modes are then obtained from the solution of an algebraic system of equations and both are actively damped. In a second approach, a disturbance observer based on a modified model for the first and second harmonic bending motion is proposed, for which the SG sensors are assumed to only measure the fundamental oscillation. Using the observer signals, only the fundamental oscillation is actively damped. The method neither includes the articulated arm nor the coupling of bending and torsion in the horizontal direction. Also, the observer does not take into account the different signal amplitudes of SG sensors and gyroscope.

SUMMARY OF THE INVENTION

It is therefore an object of the present invention to provide a method for controlling an aerial apparatus of the above kind, which provides an effective oscillation damping of the aerial apparatus by taking the coupling of bending and torsion in the horizontal direction into account, and which with minor alterations can similarly be applied for damping oscillations in the vertical direction, possibly including the effects of an articulated arm and a cage attached to the end of the articulated arm for both axes.

This object is achieved by a method comprising the features of claim 1.

In the method according to the present invention, the signals from the SG sensors and the gyroscope are obtained as raw signals. In the following, reference signals are calculated from these raw signals. These reference signals comprise an SG reference signal, related to the SG sensors, and a gyroscope reference signal. The SG reference signal represents a signal that corresponds to the angular position of the elastic deflection and the gyroscope reference signal represents an angular velocity value, each for the respective spatial axes. An additional angular acceleration reference signal is derived from angular position or angular velocity measurement values.

From these reference signals and additional model parameters that are related to the construction details of the aerial apparatus, a desired number of oscillation modes are reconstructed and used for calculating a compensation angular velocity value. In the preferred implementation, a first oscillation mode and a second oscillation mode are reconstructed. The calculated compensation angular velocity value is superimposed to a feedforward angular velocity value to result in a drive control signal that can be used, for example, for controlling a hydraulic drive.

In the dynamic model underlying this method, the fundamental oscillation of the ladder can be separated from the overtone. Additionally, the angular acceleration of each axis can be calculated on the basis of angular position measurements, and is fed to the dynamic model of the ladder to predict oscillations induced by movements of each axis. The estimated oscillation signals are used to calculate an appropriate control signal to dampen out these oscillations. This control signal is superimposed onto the desired motion command, represented by the feedforward angular velocity value, that is determined based on the reference signals read from the hand levers that are operated by the human operator, or commanded by a path-tracking control. The calculation of the desired motion command based on the reference signals is designed as to provide a smooth reaction and to reduce the excitation of oscillations of the ladder. The resulting drive control signal is passed on to the actuators used to control the drive means associated with the respective axis. This principle can be used for both the elevation/depression and for the rotation (turntable) axis. For the elevation, both oscillation modes consist of pure bending, whereas for the rotation, all oscillation modes are coupled bending-torsional oscillations.

According to a preferred embodiment of the method according to the present invention, the calculation of the SG reference signal includes calculating a strain value from a mean value of the raw signals of SG sensors measuring a vertical bending of the telescopic boom or a difference value of the raw signals of SG sensors measuring a horizontal bending of the telescopic boom, and high-pass filtering the strain value. The filtering contributes to a compensation of the offset of the signal.

According to another preferred embodiment of this method, the calculation of the SG reference signal further includes interpolating a strain offset value from the elevation angle of the telescopic boom and the extraction length of the telescopic boom, and correcting the strain value before high pass filtering by subtracting the strain offset value from the strain value. The calculation of the strain offset value compensates the influence of gravity.

According to another preferred embodiment, the interpolation of strain offset is further based on the extraction length of an articulated arm attached to the end of the telescopic boom and the inclination angle between the telescopic boom and the articulated arm.

According to still another preferred embodiment, the interpolation of strain offset value is further based on the mass of a cage attached to the end of the telescopic boom or to the end of the articulated arm and a payload within the cage.

According to another preferred embodiment of this method, the calculation of the gyroscope reference signal includes calculating a backward difference quotient of the raw signal from an angular position measurement of the elevation resp. rotation angle, to obtain an angular velocity estimate signal, filtering the angular velocity estimate signal by a low-pass filter, calculating the respective fraction of the filtered angular velocity estimate signal that is associated with each axis of the gyroscope, subtracting this fraction of the filtered angular velocity estimate signal from the original raw signal from the gyroscope to obtain a compensated gyroscope signal, and low-pass filtering the compensated gyroscope signal. This is for extracting components caused by elastic oscillations from the raw measured angular velocity of the gyroscope.

According to another embodiment of the method according to the present invention, the calculation of the compensation angular velocity value includes the addition of a position control component, which is related to a deviation of the present position from a reference position, to a signal value calculated from the reconstructed first oscillation mode and second oscillation mode.

According to still another embodiment, the feedforward angular velocity value is obtained from a trajectory planning component calculating a reference angular velocity signal based on a raw input signal, which is modified by a dynamic oscillation cancelling component to reduce the excitation of oscillations.

The present invention further relates to an aerial apparatus, comprising a telescopic boom, strain gauge (SG) sensors for detecting the bending state of the telescopic boom in horizontal and vertical directions, a gyroscope attached to the top of the telescopic boom and a controller for controlling a movement of the aerial apparatus on the basis of signal values gained from the SG sensors and the gyroscope, wherein said controller implements the control method as described above.

According to a preferred embodiment of this aerial apparatus, at least four SG sensors are arranged into two pairs, each one pair being arranged on top and at the bottom of the cross-section of the telescopic boom, respectively, with the two SG sensors or each pair being arranged at opposite sides of the telescopic boom. In this arrangement, the different values of two SG sensors arranged at the top or at the bottom of the telescopic boom or at its respective left and right sides can be used to derive a signal measuring a horizontal or vertical bending of the telescopic boom.

According to another preferred embodiment of this aerial apparatus, an articulated arm is attached to the end of the telescopic boom.

According to still another preferred embodiment, the aerial apparatus further comprises a rescue cage attached to the end of the telescopic boom or to the end of the articulated arm.

BRIEF DESCRIPTION OF THE DRAWINGS

An example of the preferred embodiment of the present invention will be described in more detail below with reference to the following accompanying drawings.

DETAILED DESCRIPTION OF THE INVENTION

Figure 1A:
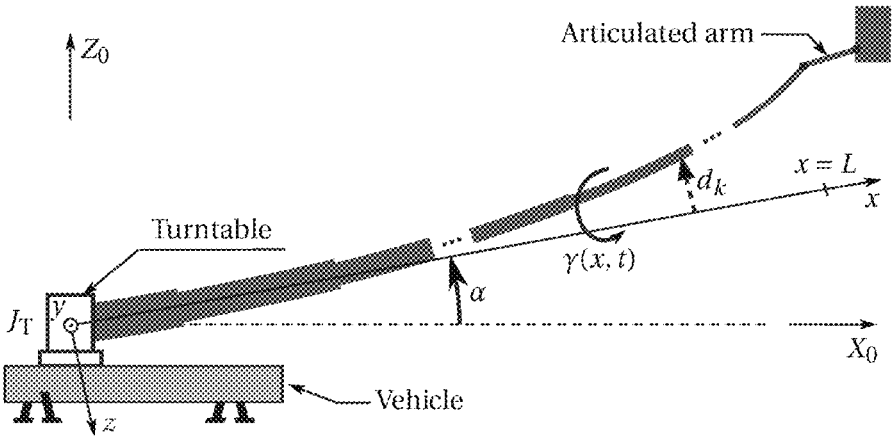
FIGS. 1*a* and *b* are schematic views of the model of an aerial apparatus, demonstrating the different model parameters, in the side view and in a view from above.
Figure 1B:
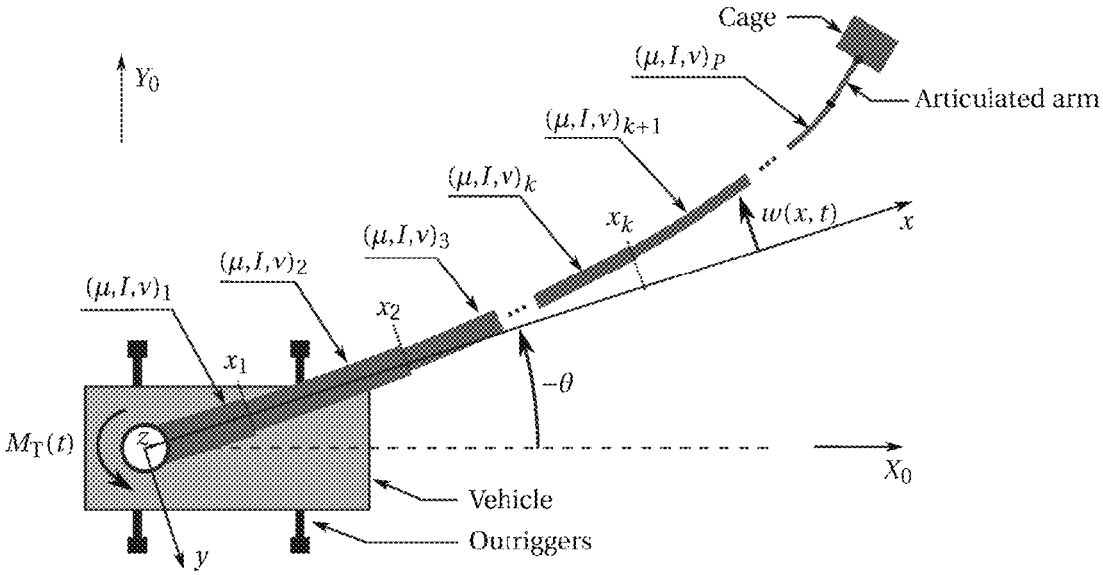
Figure 2:
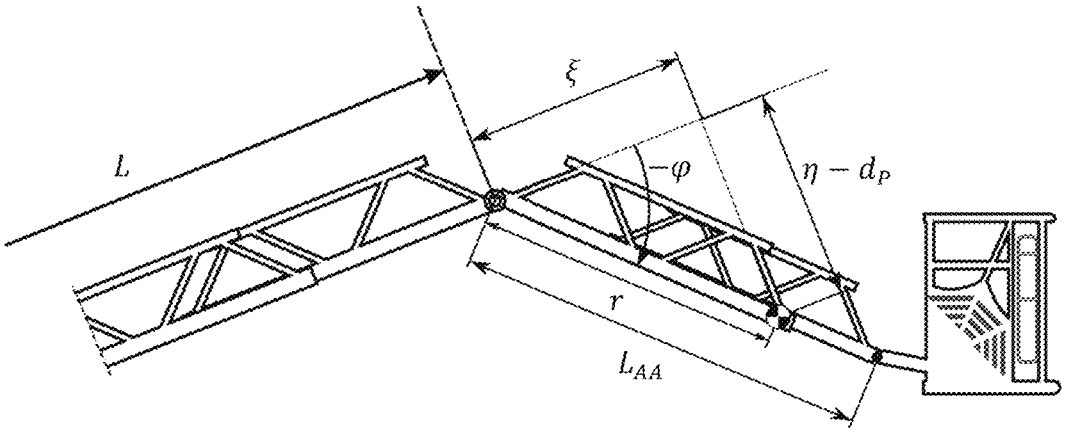
FIG. 2 is a detailed view of an aerial apparatus with a rescue cage mounted at the end of the articulated arm, demonstrating further model parameters, in a side view.

First of all, the basis of the control method according to the present invention shall be described with reference to a dynamic model that will be further described with reference to FIGS. 1*a*, 1*b* and 2.

The method for active oscillation damping, which is the subject of this patent application, is based on a model that takes into account the distributed nature of the material parameters. As the telescopic beam consists of several elements, for each of which the main physical parameters are approximately constant over the element's length, but are typically distinct from each other element, and due to the overlap of two or more telescopic elements, the physical parameters for the model are each assumed as piecewise constant. Models based on these assumptions are presented in "Verteiltparametrische Modellierung und Regelung einer 60 m-Feuerwehrdrehleiter", by Pertsch, A. and Sawodny, O., published in at-Automatisierungstechnik 9 (September 2012), pages 522 to 533, and in "2-DOF Control of a Fire-Rescue Turntable Ladder", by Zimmert, N.; Pertsch, A. und Sawodny, O., published in IEEE Trans. Contr. Sys. Technol. 20.2 (March 2012), pages 438-452, for the elevation axis, and in "Modeling of Coupled Bending and Torsional Oscillations of an Inclined Aerial Ladder", by Pertsch, A. und Sawodny, O., published in Proc. of the 2013 American Control Conference. Wash. D.C., USA, 2013, pages 4098-4103 for the rotation axis. The models known from these publications are modified to include the effects of the articulated arm on the elastic oscillations, and on the coupling of bending and torsion.

To illustrate the method, the equations of motion for the rotation axis will be shown, including the coupling of bending and torsion. The model used to describe these motions is shown in FIG. 1. Therein, $w_k(x, t)$ and $\gamma_k(x, t)$ denote the elastic bending resp. torsion, each in the k-th section of the piecewise-beam; t the time and x the spatial coordinate along the shear center axis of the boom; $\alpha$ and $\theta$ the elevation resp. rotation angle; $d_k$ the distance between shear-center axis and centroid axis of the beam; $\mu_k$ and $v_k$ the mass resp. mass moment of inertia per unit length, $I_k^z$ the area moment of inertia for bending about the z axis and $I_k^t$ the torsion constant for the cross-section; L the current length of the telescopic ladder measured from base to pivot point; $J_T$ the mass moment of inertia of the turntable, and $M_T$ the moment exerted on the turntable by the hydraulic motor. Introducing strain rate damping with damping coefficient $\beta$, and with $h_\alpha(x)=x\cos\alpha-d_k\sin\alpha$, the equations of motion in the k-th section are $$\mu_k\left(\ddot{w}_k(x,t)-d_k\ddot{\gamma}_k(x,t)+h_\alpha(x)\ddot{\theta}(t)\right)+EI_k^z\left(w_k''''(x,t)+\beta\dot{w}_k''''(x,t)\right)=0 \quad (1a)$$

$$\mu_k d_k\left(\ddot{w}_k(x,t)-d_k\ddot{\gamma}_k(x,t)+h_\alpha(x)\ddot{\theta}(t)\right)- v_k\left(\ddot{\gamma}_k(x,t)+\sin(\alpha)\ddot{\theta}(t)\right)+GI_k^t\left(\gamma_k''(x,t)+\beta\dot{\gamma}_k''(t)\right)=0, \quad (1b)$$

where a superscript dot denotes derivatives with respect to time t and a prime derivatives with respect to the spatial coordinate x. Static boundary conditions are given as $$w_1(0,t)=0,\ w'_1(0,t)=0,\ \gamma'_1(0,t)=0, \quad (2)$$

and conditions on the continuity of deflection, forces and moments at the boundaries between each two of the P sections, i.e. for k=2 . . . P−1, are $$w_k(x_k^-,t)=w_{k+1}(x_k^+,t),\ w'_k(x_k^-,t)=w'_{k+1}(x_k^+,t),\ \gamma_k(x_k^-,t)=\gamma_{k+1}(x_k^+,t) \quad (3a)$$

$$EI_k^z(w''_k(x_k^-,t)+\beta\dot{w}''_k(x_k^-,t))=EI_{k+1}^z(w''_{k+1}(x_k^+,t)+\beta\dot{w}''_{k+1}(x_k^+,t)) \quad (3b)$$

$$EI_k^z(w'''_k(x_k^-,t)+\beta\dot{w}'''_k(x_k^-,t))=EI_{k+1}^z(w'''_{k+1}(x_k^+,t)+\beta\dot{w}'''_{k+1}(x_k^+,t)) \quad (3c)$$

$$GI_k^P(\gamma'_k(x_k^-,t)+\beta\dot{\gamma}'_k(x_k^-,t))=GI_{k+1}^P(\gamma'_k(x_k^+,t)+\beta\dot{\gamma}'_k(x_k^+,t)). \quad (3d)$$

The function arguments $x_k^-$ and $x_k^+$ are introduced as short hand notation for the limit value of the corresponding functions when approaching $x_k$ from the left ($x<x_k$) resp. right side ($x>x_k$).

The effects of articulated arm and cage on the beam, both modelled as rigid bodies, are included in the model via dynamic boundary conditions. The position and orientation of these bodies depends on the pivot angle $\phi$ and—due to the horizontal leveling of the cage—also on the raising angle. For brevity, only the effects of the (changing) combined center of gravity of cage including payload and the articulated arm are illustrated in the following. Similar equations result for the model when the mass moments of inertia of articulated arm and cage are included. The location of the center of gravity mainly depends on the pivot angle $\phi$, the extraction length of the articulated arm $L_{AA}$ and the payload mass $m_p$. The overall mass of articulated arm, cage and payload are modelled as point mass located at a distance $r(L_{AA}, m_p)$ from the pivot point, as indicted in FIG. 2. With the abbreviations $\xi=r\cos\phi$ and $\eta=d_P+r\sin\phi$, the boundary conditions at x=L are then given as $$m\eta(\ddot{w}_P(L)+\xi\ddot{w}'_P(L)-\eta\ddot{\gamma}_P(L))-GI_P^t(\gamma'_P(L)+\beta\dot{\gamma}'_P(L))= -m\eta((L+\xi)\cos\alpha-\eta\sin\alpha)\ddot{\theta} \quad (4a)$$

-continued $$-m(\ddot{w}_P(L)+\xi\ddot{w}'_P(L)-\eta\ddot{\gamma}_P(L))+EI_P^z(w_P'''(L)+\beta\dot{w}_P'''(L))=m((L+\xi)\cos\alpha-\eta\sin\alpha)\ddot{\theta} \tag{4b}$$

$$-m\xi(\ddot{w}_P(L)+\xi\ddot{w}'_P(L)-\eta\ddot{\gamma}_P(L))-EI_P^z(w_P''(L)+\beta\dot{w}_P''(L))=m\xi((L+\xi)\cos\alpha-\eta\sin\alpha)\ddot{\theta}. \tag{4c}$$

The motion of the turntable is described by $$J_T\ddot{\theta}(t)-\cos\alpha(EI_1^z(w_1''(0,t)+\beta\dot{w}_1''(0,t)))-\sin\alpha(GI_1^t(\gamma_1'(0,t)+\beta\dot{\gamma}'(0,t)))=M_T \tag{5}$$

Separating time and spatial dependence in (1) by choosing $$w_k(x,t)=W_k(x)e^{j\omega t},\ \gamma_k(x,t)=\Gamma_k(x)e^{j\omega t}, \tag{6}$$

with j the imaginary unit, the characteristic equation for the eigenfunctions of the free (undamped and unforced, i.e. $\beta=0$, $\ddot{\theta}=0$) problem in the k-th section is $$\left(\frac{\partial^6}{\partial x^6}+(\nu_k+\mu_k d_k^2)\frac{\omega^2}{GI_k^t}\frac{\partial^4}{\partial x^4}-\frac{\omega^2\mu_k}{EI_k^z}\frac{\partial^2}{\partial x^2}-\frac{\omega^2\nu_k}{GI_k^t}\frac{\omega^2\mu_k}{EI_k^z}\right)W_k(x)=0. \tag{7}$$

The same characteristic equation follows for $\Gamma_k(x)$ in place of $W_k(x)$. $\omega$ denotes the eigen angular frequency of the corresponding eigenmode. The solutions to the spatial differential equation (7) are given as the eigenfunctions $$W_k(x)=A_{1k}\sinh(s_{1k}x)+A_{2k}\cosh(s_{1k}x)+A_{3k}\sin(s_{2k}x)+A_{4k}\cos(s_{2k}x)+A_{5k}\sin(s_{3k}x)+A_{6k}\cos(s_{3k}x) \tag{8a}$$

$$\Gamma_k(x)=B_{1k}\sinh(s_{1k}x)+B_{2k}\cosh(s_{1k}x)+B_{3k}\sin(s_{2k}x)+B_{4k}\cos(s_{2k}x)+B_{5k}\sin(s_{3k}x)+B_{6k}\cos(s_{3k}x) \tag{8b}$$

The relationship between the dependent coefficients $A_{nk}$ and $B_{nk}$ is obtained by substituting the eigenfunctions (8) together with (6) into the equations of motion (1), and using the simplifications stated before that result from the assumptions of free, undamped and unforced motion. Using these relationships, the coefficients $s_{nk}$, and $A_{nk}$ resp. $B_{nk}$ (up to a scaling constant), as well as the eigenfrequencies $\omega$, can be obtained by substituting (8) into the equations resulting from the boundary and continuity conditions (2)-(4), and applying the same assumptions made before. The coefficients then follow as the non-trivial solutions of the resulting system of equations.

In the following, the spatial index k is dropped, keeping the piecewise definitions of W(x) and $\Gamma(x)$ in mind. The eigenvalue problem has an infinite number of solutions that shall be denoted as $W^i(x)$ and $\Gamma^i(x)$ for the eigenfunctions that belong to the i-th eigenfrequency $\omega_1$. Using the series representations $$w(x,t)=\Sigma_{i=1}^{\infty}W^i(x)f_i(t),\ \gamma(x,t)=\Sigma_{i=1}^{\infty}\Gamma^i(x)f_i(t),$$

with $f_i(t)$ describing the evolution of the amplitude of the i-th eigenfunction over time, and substituting these series representations into the equations of motion and into the boundary and continuity conditions, the following ordinary differential equations can be obtained for each mode:

$$a_i(\ddot{f}_i(t)+\beta\omega_i\dot{f}_i(t)+\omega_i^2 f_i(t))=\left(\frac{GI_1^t}{\omega_i^2}(\Gamma^i)'\Big|_{x=0}\sin\alpha+\frac{EI_1^z}{\omega_i^2}(W^i)''\Big|_{x=0}\cos\alpha\right)\ddot{\theta}(t),\quad i=1\ldots\infty \tag{9}$$

$\alpha_i$ is a normalization constant that depends on the (non-unique) scaling of the eigenfunctions. Thus, by choosing an appropriate scaling, $\alpha_i=1$ is assumed in the following.

By truncating the infinite system of equations (9) at a desired number of modes, a finite-dimensional modal representation is obtained, where the number of modes is chosen to achieve the desired model accuracy. In the following, the active oscillation damping for the first two harmonics is described, which is often sufficient due to natural damping of higher modes and the limited bandwidth of the actuators. An extension to including a higher number of nodes in the active oscillation damping is straightforward.

Introducing the state vector=$[f_1, \dot{f}_1, f_2, \dot{f}_2]^t$, the equations of motion for the first two modes can be written as $$\dot{x}=\begin{bmatrix}0 & 1 & & \\ -\omega_1^2 & -\beta\omega_1 & & \\ & & 0 & 1\\ & & -\omega_2^2 & -\beta\omega_2\end{bmatrix}x+\begin{bmatrix}0 & 0\\ b_1^s & b_1^c\\ 0 & 0\\ b_2^s & b_2^c\end{bmatrix}\begin{bmatrix}\sin\alpha\\ \cos\alpha\end{bmatrix}\ddot{\theta}=Ax+B(\alpha)\ddot{\theta} \tag{10}$$

with system matrix A and input matrix B. The definitions of $b_i^s$ and $b_i^c$ are obvious from (9).

The turntable dynamics (5) are compensated by an inner control loop, which also provides set point tracking for the desired angular velocity of the turntable rotation. If this control loop is sufficiently fast compared to the eigenvalues, the actuator dynamics (5) can be approximated as a first-order delay $$\tau\ddot{\theta}+\dot{\theta}=u \tag{11}$$

If the delay time constant $\tau$ is sufficiently small, the input can directly be seen as velocity reference input $\dot{\theta}\approx u$, so that the angular acceleration in (10) can be replaced by $\ddot{\theta}\approx\dot{u}$. Based on the model description (10), the control feedback signal $u_{fb}$ for active oscillation damping is obtained using the state feedback law $$u_{fb}=-[k_1^p\ k_1^d\ k_2^p\ k_2^d]x \tag{12}$$

With an appropriate choice of feedback gains, the closed-loop poles can be set to achieve the desired dynamic behavior and especially to increase the level of damping. The gains kr and $k_i^d$ are adapted based on the raising angle $\alpha$, the pivot angle $\phi$ of the articulated arm, and the lengths of ladder L and articulated arm $L_{AA}$. If the inner control loop for the turntable dynamics is sufficiently fast, i.e. the input can be seen as reference for the rotation velocity, a partial state feedback is sufficient to increase the damping, with $$u_{fb}=-[k_1^p\ 0\ k_2^p\ 0]x. \tag{13}$$

To implement either the full or the partial state feedback law, the state vector must be known. In the preferred realization, a full state observer is used to determine the state vector. In an alternative realization, a partial reconstruction of the state vector is given as the solution to an algebraic system of equations, where the method known from EP 2 022 749 B2 is extended to coupled bending-torsion oscillations. For either method, measurements of the oscillations are necessary. Technically feasible solutions include measurements of the hydraulic pressure of the actuators, measurement of the surface strain of the boom using strain gauges, and inertial measurements e.g. using accelerometers or gyroscopes. Alternatively, measurements of the angular rate in bending direction, i.e. about an axis orthogonal to the boom, or measurements of strain gauges attached to the top or bottom side of the boom might be used in addition to the strain gauges at the sides. To minimize distortions caused e.g. by vertical bending, the difference between the strain gauges on both sides is used, as for horizontal bending both signals change in opposite directions due to the position of the strain gauges on opposing sides of the beam. In the preferred configuration with strain gauges at $x=x_{SG}$ (denoting their difference as $\epsilon_h$) and of a gyroscope at $x=x_{Gy}$ measuring angular velocities of rotations about the longitudinal axis of the beam (signal $m_T$), the measurement equation for the state space system is $$y=\begin{bmatrix}\varepsilon_h\\ m_T\end{bmatrix}=\begin{bmatrix}\zeta(W^1)''(x_{SG}) & 0 & \zeta(W^2)''(x_{SG}) & 0\\ 0 & \Gamma^1(x_{Gy}) & 0 & \Gamma^2(x_{Gy})\end{bmatrix}x+\begin{bmatrix}0\\ -\sin\alpha\end{bmatrix}\dot{\theta}=Cx+D(\alpha)\dot{\theta}, \tag{14}$$

where $\zeta$ is the distance of the strain gauges to the neutral (strain-free) axis of the horizontal bending. Alternatively, the measurements of angular velocities of rotations about the axis orthogonal to the beam's top or bottom surface can be used, which are obtained from a gyroscope at $x=x_{Gy}$ (signal $m_R$), resulting in the measurement equation $$y=\begin{bmatrix}\varepsilon_h\\ m_R\end{bmatrix}=\begin{bmatrix}\zeta(W^1)''(x_{SG}) & 0 & \zeta(W^2)''(x_{SG}) & 0\\ 0 & (W^1)'(x_{Gy}) & 0 & (W^2)'(x_{Gy})\end{bmatrix}x+\begin{bmatrix}0\\ \cos\alpha\end{bmatrix}\dot{\theta}.$$

For brevity, only the measurement equation as given in (14) is considered hereinafter. A more convenient representation for the output matrix C is obtained by scaling the state vector x. To represent the system in "gyroscope coordinates", the transformation $\tilde{x}=Tx$ can be applied to the system matrix (10) and the output matrix (14), with T given as the non-singular diagonal transformation matrix $$T=\mathrm{diag}([\Gamma^1(x_{Gy}),\ \Gamma^1(x_{Gy}),\ \Gamma^2(x_{Gy}),\ \Gamma^2(x_{Gy})]).$$

The resulting transformed system equations are $$\dot{\tilde{x}}=TAT^{-1}\tilde{x}+TB\ddot{\theta},\quad y=CT^{-1}\tilde{x}+D(\alpha)\dot{\theta}. \tag{15}$$

As the transformation corresponds to a pure scaling of the state variables, the system matrix is invariant under this transformation, i.e. $TAT^{-1}=A$. However, the output matrix is normalized so that all non-zero entries in the second row corresponding to the gyroscope measurements are unity, $$y=CT^{-1}=\begin{bmatrix}c_1 & 0 & c_2 & 0\\ 0 & 1 & 0 & 1\end{bmatrix}x+\begin{bmatrix}0\\ -\sin\alpha\end{bmatrix}\dot{\theta}. \tag{16}$$

Similarly, the state space system can also be transformed to "strain coordinates" for which the corresponding entries in the first row of the output matrix are unity and the entries in the second row vary. Also, combinations of both are possible, e.g. representing the first mode in "strain coordinates" and the second in "gyroscope coordinates", as for $$y=\begin{bmatrix}c_1 & 0 & 1 & 0\\ 0 & 1 & 0 & g_2\end{bmatrix}x+\begin{bmatrix}0\\ -\sin\alpha\end{bmatrix}\dot{\theta}. \tag{17}$$

All of these normalized representations have the advantage that the number of system parameters that are to be determined, stored and to be adapted during operation is minimized. As an improvement compared to EP 2 022 749 B2, the system description in (14) takes into account that the strain gauges also measure the second harmonic oscillation, and that the amplitudes of strain gauges and gyroscope measurements are not identical. All parameters of the system equations (10) and the output equations (16) resp. (17) can be identified from experimental data via suitable parameter identification algorithms.

To reconstruct the elastic oscillations from the measurements, first the rigid-body rotation caused by rotations of the turntable rotation is subtracted from the measured gyroscope signal. The angular velocity of each axis can be obtained by numerical differentiation of measurements of the raising angle $\alpha$ and the rotation angle $\theta$, respectively, which are provided for example by incremental or absolute encoders. Alternatively, additional gyroscopes at the base of the ladder that are not subject to elastic oscillations could be used to obtain the angular velocities. In a second step, both the strain gauge signal and the compensated gyroscope signal are filtered to reduce the influences of static offsets and measurement noise on the signals, whereby the filter frequencies are chosen at a suitable distance to the eigenfrequencies of the system as not to distort the signals. The compensated and filtered signals are denoted as $\tilde{y}$ in the following.

In the preferred realization, a Luenberger observer is designed, based on a system representation with measurement matrix (17). The system matrix $\hat{A}=A$ is given in (10) and the input matrix $\hat{B}(\alpha)$ is obtained from (10), applying a suitable coordinate transformation as shown in (15) so that the output matrix $\hat{C}$ is in the form of the first matrix in (17). The observer state vector $$\hat{x}=[f_1,\dot{f}_1,f_2,\dot{f}_2,\epsilon^{off},m^{off}]^t \tag{18}$$

is augmented with offset states for each the strain gauges and the gyroscope to take into account the offsets that remain after filtering. The observer equations are given as $$\dot{\hat{x}}=\hat{A}\hat{x}+\hat{B}(\alpha)\ddot{\hat{\theta}}+L(\tilde{y}-C\hat{x}). \tag{19}$$

With an appropriate choice for the elements of the observer gain matrix L, the convergence rate and the disturbance rejection of the observer can be adjusted to achieve a desired behavior. The estimate for the angular acceleration $\ddot{\hat{\theta}}$ can be obtained by numerical differentiation of the estimated turntable velocity, augmented by a suitable filtering to suppress measurement and quantization noise. As the state observer explicitly includes the excitation of oscillations by angular accelerations of the turntable, these oscillations can in a sense be predicted, which improves the response time for the active oscillation damping. The state estimates obtained from the observer are used to implement the state feedback law (12) resp. (13). The estimation of the first mode in "strain coordinates" is preferably to gyroscope coordinates, as the relation between the direction of turntable accelerations and the resulting bending does not change sign, regardless of the pivot angle, in contrast to the torsional component of the oscillations. In comparison, the second harmonic needs to be estimated from the gyroscope measurements as these oscillations are mainly limited to the upper parts of the telescopic boom and their amplitudes are comparatively low in the strain gauge signals due to the increasing dimensions and bending stiffness towards the base.

In an alternative realization, the eigenmodes are directly obtained as solution of a linear system of equations as known from EP 2 022 749 B2. With the system representation derived for the coupled oscillations, the method presented therein can be applied. The compensated and filtered gyroscope signal $\tilde{m}_T$ is integrated over time, and estimates for the eigenmodes are then obtained as $$\begin{bmatrix} \hat{f}_1 \\ \hat{f}_2 \end{bmatrix} = \begin{bmatrix} c_1 & 1 \\ 1 & g_2 \end{bmatrix}^{-1} \begin{bmatrix} \tilde{\varepsilon}_h \\ \int_0^t \tilde{m}_T(\tau)\, d\tau \end{bmatrix}. \tag{20}$$

Inversion of the output matrix is possible if $c_1 g_2 \neq 1$. To increase the robustness against model uncertainties and to improve the separation, the estimated eigenmodes additionally need to be filtered. For this method, the number of measurements must be equal to the number of eigenmodes that shall be reconstructed, so that an extension to a higher number of modes requires additional sensors. To use the gyroscope axis $m_R$ instead of $m_T$ in (20), the coefficients $c_1$ and $g_2$ need to be chosen appropriately.

For the elevation axis, other than for the rotation axis, no coupling effects need to be considered, and the eigenmodes can be modeled as pure bending. Denoting the bending in the vertical direction as $v_k(x, t)$, the equations of motion $$\mu_k(\ddot{v}_k(x,t)+x\ddot{\alpha}(t))+EI_k^y(v''''_k(x,t)+\beta\dot{v}''''_k(x,t))=0 \tag{21}$$

are similar to the first equation of motion for the rotation axis (1a), except that no torsional deflections need to be considered ($\gamma_k(x, t)\equiv 0$). The effects of gravity predominantly cause a static deflection that does not influence the elastic motion about an equilibrium, and are thus not included in the dynamic model. Furthermore, the distance $h_\alpha(x)$ in (1a) is replaced by the distance x along the boom's longitudinal axis, and the bending stiffness by the corresponding constant for bending about the z-axis. Note that the damping coefficient β is related to the bending in vertical direction and its value is typically different from the one for horizontal bending. The boundary and continuity conditions are given by (2) and (3) when replacing $w_k$ by $v_k$, where the conditions for $\gamma_k$ are of no interest. Equivalently, the boundary conditions at the top end are given by (4b,c) with $\eta=0$, again substituting in the deflection and the bending stiffness for the vertical axis. For brevity of the presentation, these equations are therefore not repeated. Similar treatment of the equations of motion as for the rotation axis leads o an fourth order eigenvalue problem for the free, undamped motion as outlined for example in "Verteiltparametrische Modellierung . . . ", by Pertsch and Sawodny, cited before. Using the resulting eigenfunctions, the elastic oscillations can be described based on the series representation $$v(x,t)=\Sigma_{i=1}^{\infty} V^i(x) f_i(t)$$

With an appropriate normalization of the eigenfunctions, the time dependency $f_i(t)$ of each mode is given by the following ordinary differential equation, similar to (9):

$$\left(\ddot{f}_i(t) + \beta\omega_i \dot{f}_i(t) + \omega_i^2 f_i(t)\right) = \frac{EI_1^y}{\omega_i^2}(V^i)''\Big|_{x=0} \ddot{\alpha}(t), \quad i = 1 \ldots \infty \tag{22}$$

For a finite-dimensional approximation with two modes, the state vector $x=[f_1, \dot{f}_1, f_2, \dot{f}_2]^t$ is introduced, and the equations of motion for the first two modes can be written as $$\dot{x} = \begin{bmatrix} 0 & 1 & & \\ -\omega_1^2 & -\beta\omega_1 & & \\ & & 0 & 1 \\ & & -\omega_2^2 & -\beta\omega_2 \end{bmatrix} x + \begin{bmatrix} 0 \\ b_1 \\ 0 \\ b_2 \end{bmatrix} \ddot{\alpha} = Ax + B\ddot{\alpha} \tag{23}$$

Even though the notation for the elevation axis has been chosen mostly identical to the notation for the rotation axis to simplify the comparison, all variables in (23) refer to vertical bending oscillations and are independent from the horizontal bending oscillations considered before. Using an appropriate scaling for the state vector, the system output, given as the measurement of strain gauges at the bottom and a gyroscope at the tip, can be written as $$y = \begin{bmatrix} c_1 & 0 & c_2 & 0 \\ 0 & 1 & 0 & 1 \end{bmatrix} x + \begin{bmatrix} 0 \\ 1 \end{bmatrix} \dot{\alpha}. \tag{24}$$

Based on this system description, the full state vector can be estimated using a Luenberger observer, or a partial state vector via inversion of the output matrix similar to (20), which shall not be repeated in detail.

The oscillation damping method described before considers the dampening of oscillations after they have been induced. In addition to this method, the excitation of oscillations during actively commanded motions of the boom can be reduced using an appropriate feedforward control method. The feedforward control method consists of two main parts: a trajectory planning component and a dynamic oscillation cancelling component. The trajectory planning component calculates a smooth reference angular velocity signal based on the raw input signal as commanded by the human operator via hand levers, or as obtained from other sources like an automatic path following control. Typically, the rate of change and the higher derivatives of the raw input signal are unbounded. If such raw signals were directly used as commands to the drives, the entire structure of the aerial ladder would be subject to high dynamic forces, resulting in large material stress. Thus, a smooth velocity reference signal must be obtained, with at least the first derivative, i.e. the acceleration, but favorably also the second derivative, i.e. the jerk, and higher derivatives are bounded. To obtain a jerk bounded reference signal, a second order filter, or a nonlinear rate limiter together with a first order filter can be employed. The filters can be implemented as finite (FIR) or infinite impulse response (IIR) filters. Such filters improve the system response by reducing accelerations and jerk, but a significant reduction of the excitation of especially the first oscillation mode is only possible with a significant prolongation of the system's response time.

To improve the cancellation of oscillations, an additional oscillation cancelling component can be employed. For oscillatory systems similar to (9,10) resp. (22,23), an method based on the concept of differential flatness is proposed in "Flatness based control of oscillators" by Rouchon, P., published in ZAMM—Journal of Applied Mathematics and Mechanics, 85.6 (2005), pp. 411-421. Within the framework of differential flatness, the time evolution of the system states, which are here the flexible oscillation modes, and of the system's input are parameterized using a so-called virtual "flat output". Based on the results published by Rouchon, the time evolution of the flexible oscillation modes in (10) resp. (23) neglecting damping and under the assumption of a fast actuator response, i.e. a direct velocity input $\dot{\theta}=u$ resp. $\dot{\alpha}=u$, is $$f_1^R = \frac{B_2}{\omega_1}\left(\dot{Z} + \frac{\dddot{z}}{\omega_2^2}\right),$$

$$f_2^R = \frac{B_4}{\omega_2}\left(\dot{Z} + \frac{\dddot{z}}{\omega_2^2}\right).$$

The derivatives $f_i^R$ follow immediately. Therein, $B_i$ denotes the i-th row of the corresponding input matrix B in (10) resp. (23), and z the trajectory for the "flat output". If the time derivatives of the trajectory z vanish after a certain transition time, no residual oscillations remain. The reference angular velocity that is required to realize these trajectories is given as $$u^{ff} = z + \left(\frac{1}{\omega_1^2} + \frac{1}{\omega_2^2}\right)\ddot{Z} + \frac{1}{\omega_1^2\omega_2^2}\frac{d^4z}{dt^4}.$$

Thus, the reference trajectory z provided by the trajectory planner and obtained from the raw input signal must be at least four times continuously differentiable. For the implementation, the trajectory planning component and the oscillation damping components can be implemented separately as described before, or can be combined so that the reference trajectory z and its derivatives are not calculated explicitly.

When an oscillation damping component is included in the feedforward signal path, the state vector in the full (12) resp. partial (13) state feedback law must be replaced by the deviation from the reference trajectory for the states, which results for example for the full state feedback (12) in $$u_{fb} = -[k_1^p\ k_1^d\ k_2^p\ k_2^d]\ (x - [f_1^R\ \dot{f}_1^R\ f_2^R\ \dot{f}_2^R]^t).$$

Figure 3:
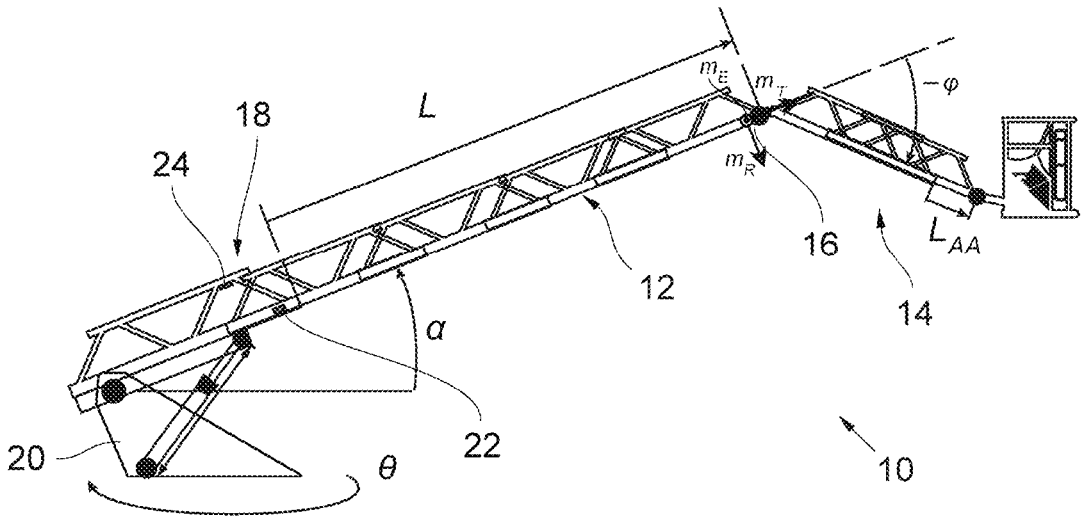
FIG. 3 is another side view of a complete aerial apparatus according to one embodiment of the present invention, demonstrating the positions of the sensors.

The model described above is implemented in a control system of an aerial apparatus 10, as shown in FIG. 3 in a side view. This aerial apparatus 10 comprises a telescopic boom 12 that can be rotated as a whole round a vertical axis, wherein θ represents the rotation angle. Moreover, the telescopic boom 12 can be elevated by an elevation angle α, and the articulated arm 14 attached to the end of the telescopic boom 12 can be inclined with respect to the telescopic boom 12 by an inclination angle ϕ, defined as positive in the upwards direction. The angular velocities measured by the gyroscope are defined as $m_T$, $m_E$, and $m_R$, for the axes parallel to the longitudinal axis of the boom, the axis orthogonal to the boom and in the horizontal plane, and the axis orthogonal to the boom in the vertical plane, respectively. In the present embodiment of the aerial apparatus 10, the gyroscope 16 is positioned at the pivot point between the end of the telescopic boom 12 and the articulated arm 14.

Strain gauge sensors 18 are attached to the telescopic boom 12. In the present example, these strain gauge sensors (or SG sensors 18 in short) are positioned close to the base 20 of the aerial apparatus 10. In particular, four SG sensors 18 are arranged in two pairs. A first pair 22 of SG sensors is positioned at the bottom of the cross-section of the telescopic boom 12, wherein each sensor of this pair 22 is disposed at one side (i.e. left and right side) of the telescopic boom 12. The SG sensors of the second pair 24 are positioned on the top chord of the truss framework of the telescopic boom 12, in a way that each SG sensor of this pair 24 is attached at one lateral side of the telescopic boom 12. As a result, at each side of the telescopic boom 12, two SG sensors, including one sensor of each pair 22,24, respectively, are attached above another. If the telescopic boom 12 is distorted or bent laterally, i.e. in a horizontal direction, the SG sensors of each pair 22,24 are expanded differently, because the left and right longitudinal beams within the framework of the telescopic boom 12 are expanded differently. The same is the case with the upper and lower beams of the framework in case of a vertical bending of the telescopic boom 12, such that the upper and lower SG sensors 18 are expanded differently. In particular it is also possible to detect torsion movements of the telescopic boom 12 in this arrangement.

The aerial apparatus 10 shown in FIG. 3 further comprises a controller for controlling a movement of the aerial apparatus 10 of the basis of signal values gained from the SG sensors 18 and the gyroscope 16. The control system representing the model described above and implemented within this controller is shown schematically in FIG. 4 and shall be described hereinafter.

Figure 4:
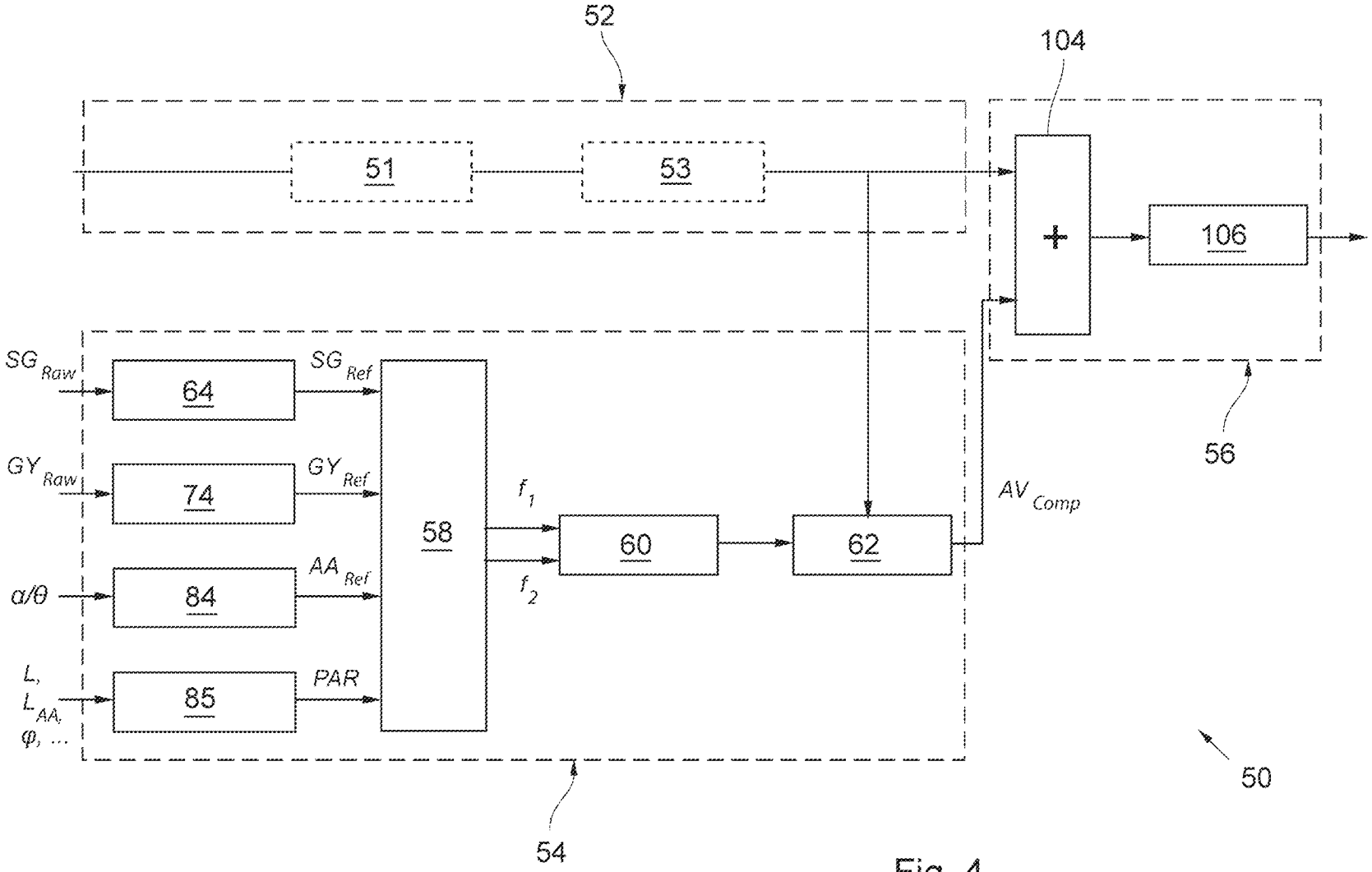
FIG. 4 is a schematic view of the control system implemented in the controller of the aerial apparatus according to the present invention.

One control system of the kind shown in FIG. 4 is implemented for each axis of the aerial apparatus 10. Each control system 50 generally comprises a feedforward branch 52, a feedback branch 54, and a drive control signal calculation branch 56. In the feedforward branch 52, a reference angular velocity value as a motion command, which can be obtained from hand levers that are operated by a human operator or which can be obtained from a trajectory tracking control for example to replay a previously recorded trajectory, or the like, is processed. The feedback branch 54 outputs a calculated compensation angular velocity value to compensate oscillations of the aerial apparatus 10, in particular of the telescopic boom 12 and articulated arm 14. The resulting signals output by the feedforward branch 52 and the feedback branch 54, namely the feedforward angular velocity value resulting from the reference angular velocity value and the calculated compensation angular velocity value, are both input into the drive control signal calculation branch 56 to calculate a drive control signal, that can be used by a driving means such as a hydraulic driving unit or the like.

Within the feedback branch 54, raw signals $SG_{Raw}$, $GY_{Raw}$ that are obtained from the SG sensors 18 and the gyroscope 16 are used to calculate reference signals, including an SG reference signal $SG_{Ref}$ and a gyroscope reference signal $GY_{Ref}$, which represent strain and angular velocity values, respectively. Additionally, an angular acceleration reference signal $AA_{Ref}$ that is derived from angular position values is also calculated as a reference signal. The reference signals $SG_{Ref}$, $GY_{Ref}$, $AA_{Ref}$ are input into an observer module 58, together with additional model parameters PAR that are related to the construction of the aerial apparatus 10, such as the lengths of the telescopic boom 12 and the articulated arm 14, the present elevation angle α of the telescopic boom 12, the inclination angle ϕ of the articulated arm 14, or the like. From the reference signals $SG_{Ref}$, $GY_{Ref}$, $AA_{Ref}$ and the additional model parameters PAR, the observer module 58 reconstructs a first oscillation mode $f_1$ and a second oscillation mode $f_2$, which are input into a control module 60 for calculating the compensation angular velocity value from the reconstructed first oscillation mode $f_1$ and second oscillation mode $f_2$. The compensation angular velocity value is output via a validation and release module 62 to the drive control signal calculation branch 56. The validation and release implements a logic to decide whether an active oscillation command is to be issued to the drive control signal branch.

Figure 5:
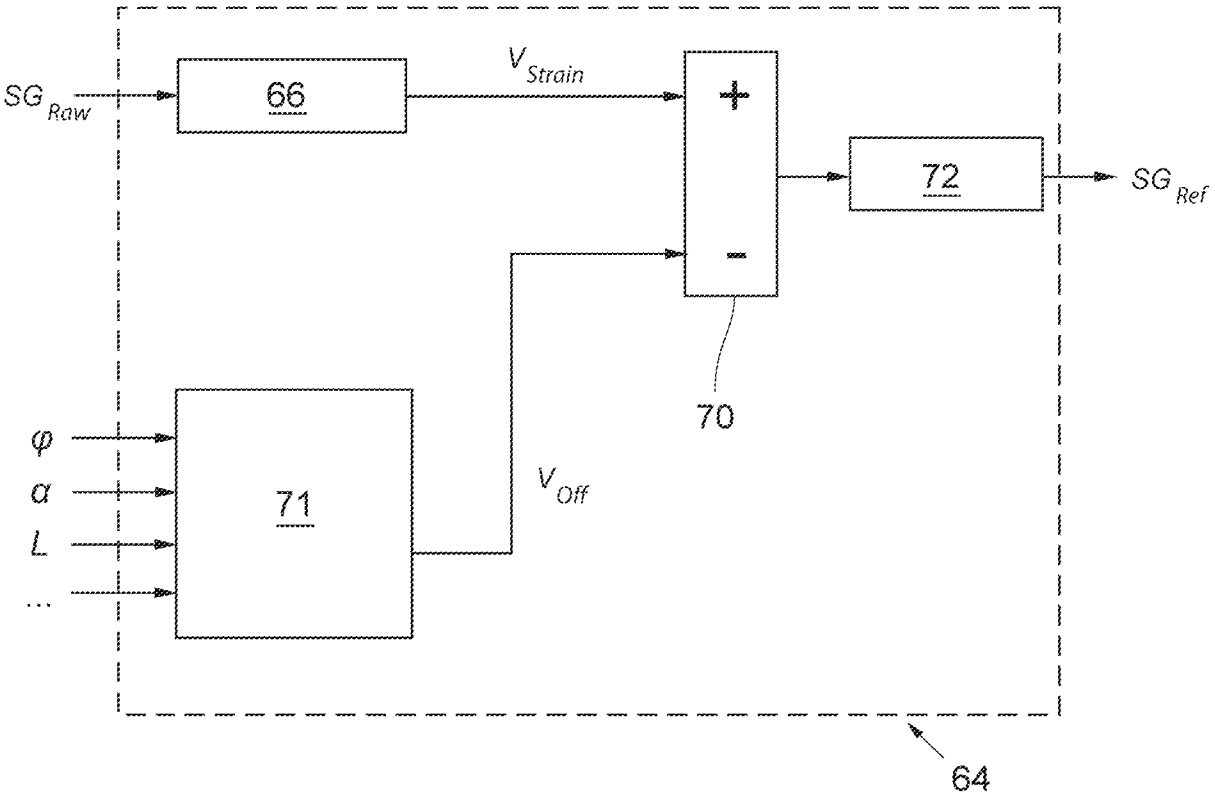
FIGS. 5 and 6 are detailed schematic views showing parts of the control system of FIG. 4, demonstrating the calculation of the SG reference signal and the gyroscope reference signal, respectively.

The calculation of the SG reference signal $SG_{Ref}$ is described in more detail with reference to FIG. 5, showing an SG reference signal calculation branch 64. In an operation step marked by item number 66 in FIG. 5, a strain value $V_{Strain}$ is calculated from a mean value of the raw signals $SG_{Raw}$ of SG sensors 18 measuring a vertical bending of the telescopic boom, or alternatively, from a difference value of the raw signals $SG_{Raw}$ of SG sensors 18 measuring a horizontal bending of the telescopic boom 12, depending on the respective spatial axis that is considered in this calculation. In case of the calculation of the strain value $V_{strain}$ for elevation, i.e. considering the case of a vertical bending of the telescopic boom 12, a strain offset value $V_{Off}$ is calculated in operation step 71 at least from the elevation angle $\alpha$ of the telescopic boom 12, the lengths L of the telescopic boom 12 and $L_{AA}$ of the articulated arm 14, the inclination angle $\phi$ between the telescopic boom 12 and the articulated arm 14, the mass of the cage attached to the end of the articulated arm 14, and a payload within this cage. The strain value $V_{Strain}$ that is calculated in operation step 66 is corrected by subtracting the strain offset value $V_{Off}$ calculated in operation step 71 from the strain value (operation step 70). The interpolation of the strain offset value is effective to prevent changes of the offset, in particular during extraction and retraction or raising and lowering of the telescopic boom 12 not to be interpreted as an oscillation movement. The resulting (corrected) strain value is filtered afterwards in a high-pass filter 72 before being output as SG reference signal $SG_{Ref}$ into the observer module 58.

This high pass filter 72 is a high pass of first or higher order. The cutoff frequency of this high pass filter 72 is at about 20% of the eigenfrequency of the respective fundamental oscillation mode. Because of this dependency on the eigenfrequency, the filtering effect is improved for short lengths of the telescopic boom 12 where the first eigenfrequency is higher than for larger lengths, because filtering of changes of the offset during extending, retracting, raising or lowering the boom is performed more effectively as the cutoff frequency can be chosen higher as for longer extraction lengths, which shortens the time response of the filter.

Figure 6:
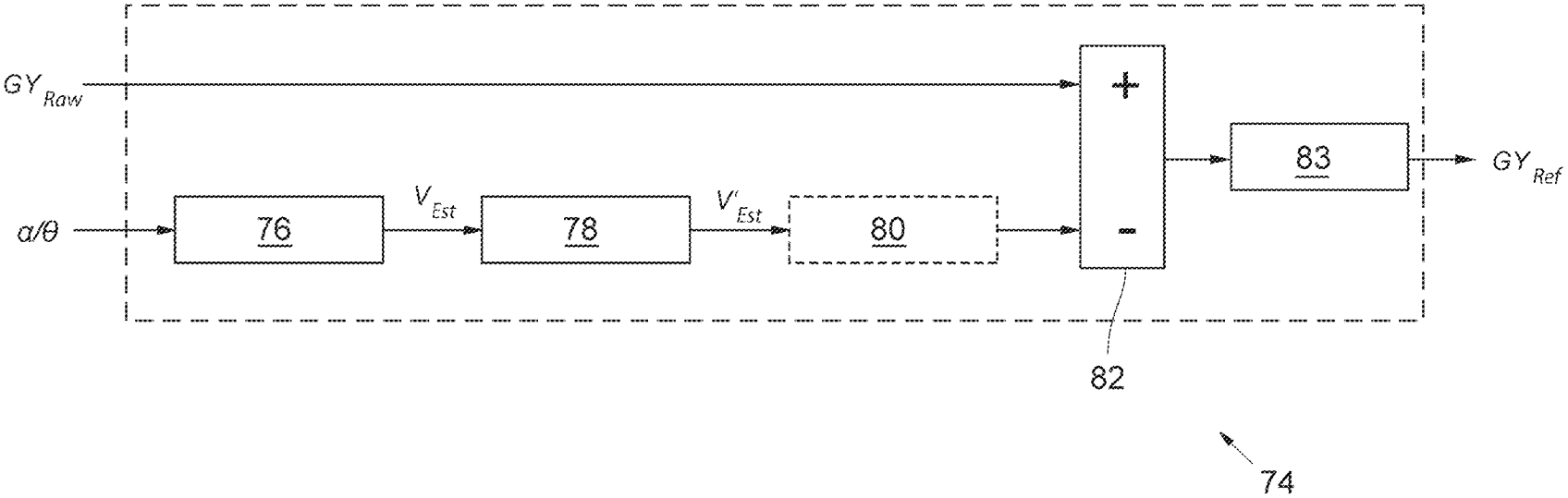

FIG. 6 shows a gyroscope reference signal calculation branch 74 for calculating the gyroscope reference signal from the gyroscope raw signal for the respective axis. Within the gyroscope reference signal calculation branch 74, a backward difference quotient of the angular position measurement signal is calculated in operation step 76 to obtain a raw velocity estimate signal $V_{Est}$, which is in turn input into a low pass filter 78 of second order. In case of the axis for elevation, the filtered velocity estimate signal $V'_{Est}$ is directly subtracted from the original raw signal $GY_{Raw}$ of the gyroscope (operation step 82) to obtain a compensated gyroscope signal $GY_{Comp}$, which is passed through a low pass filter 83 of first order and output as gyroscope reference signal $GY_{Ref}$.

In case of the turning axis, the part of the angular velocity $V'_{Est}$ must be obtained that corresponds to the respective gyroscope axis for torsion or rotation, which depends on the elevation angle $\alpha$ (operation step 80). Afterwards the operation 82 as described above is carried out, i.e. subtracting the resulting fraction of the filtered velocity estimate signal $V'_{Est}$ from the original raw signal $GY_{Raw}$ of the gyroscope.

Referring again to FIG. 4, in an angular acceleration calculation branch 84, an angular acceleration reference signal $AA_{Ref}$ is derived from the angular velocity values by calculating a difference quotient of second order, to predict oscillations to a certain extend. The resulting angular acceleration reference signal $AA_{Ref}$ is also input into the observer module 58. Optionally the angular acceleration reference signal $AA_{Ref}$ can be filtered.

Within the observer module 58, the temporal development of the first oscillation mode and the second oscillation mode are reconstructed from the SG reference signal, the gyroscope reference signal, the angular acceleration reference signal, and additional model parameters related to the construction of the aerial apparatus 10. This is performed according to the following model. The parameters 85 used in the model are stored and adapted during operation based on the lengths L of the boom, $L_{AA}$ of the articulated arm, inclination angle $\phi$ between the telescopic boom and the articulated arm, and the current load in the cage, as necessary for the particular ladder model.

The Luenberger observer for the axis for elevation, with the observer state vector given in (18), is given by $$\dot{\hat{x}} = \begin{bmatrix} 0 & 1 & 0 & 0 & 0 & 0 \\ -\omega_1^2 & -\beta\omega_1 & 0 & 0 & 0 & 0 \\ 0 & 0 & 0 & 1 & 0 & 0 \\ 0 & 0 & -\omega_2^2 & -\beta\omega_2 & 0 & 0 \\ 0 & 0 & 0 & 0 & 0 & 0 \\ 0 & 0 & 0 & 0 & 0 & 0 \end{bmatrix} \hat{x} + \begin{bmatrix} 0 \\ b_1 \\ 0 \\ b_2 \\ 0 \\ 0 \end{bmatrix} \ddot{\alpha} + L\left( \begin{bmatrix} \tilde{\epsilon}_v \\ \tilde{m}_E \end{bmatrix} - \begin{bmatrix} c_1 & 0 & c_2 & 0 & 1 & 0 \\ 0 & 1 & 0 & 1 & 0 & 1 \end{bmatrix} \hat{x} \right) \tag{25}$$

In this formula $\tilde{\epsilon}_v$ is the resulting SG reference signal (processed and filtered) of the vertical SG sensors, and $\tilde{m}_E$ is the processed and filtered gyroscope reference signal for the elevation axis. Remaining offsets are modeled as random walk disturbances and considered by the observer module 58. The adaption to different lengths and angles is carried out by adapting the eigenfrequencies $\omega_i$, damping coefficients $\beta$, input parameters $b_i$, output parameters $c_i$ and the coefficients of the observer matrix L. To reduce the number of coefficients to be stored and adapted online, the coefficients can be calculated depending on the parameters of the system model (21) that are adapted online.

The dynamic equations for the turning axis are generally identical to the elevation axis. The same state vector (18) is chosen for the observer, with the offsets referring to the appropriate sensor signals. Similar to the equations above, the dynamic equation system of the Luenberger observer is given as $$\dot{\hat{x}} = \begin{bmatrix} 0 & 1 & 0 & 0 & 0 & 0 \\ -\omega_1^2 & -\beta\omega_1 & 0 & 0 & 0 & 0 \\ 0 & 0 & 0 & 1 & 0 & 0 \\ 0 & 0 & -\omega_2^2 & -\beta\omega_2 & 0 & 0 \\ 0 & 0 & 0 & 0 & 0 & 0 \\ 0 & 0 & 0 & 0 & 0 & 0 \end{bmatrix} \hat{x} + \begin{bmatrix} 0 & 0 \\ g_1^s & g_1^c \\ 0 & 0 \\ b_2^s & b_2^c \\ 0 & 0 \\ 0 & 0 \end{bmatrix} \begin{bmatrix} \sin\alpha \\ \cos\alpha \end{bmatrix} \ddot{\theta} + L\left( \begin{bmatrix} \tilde{\varepsilon}_h \\ \tilde{m}_T \end{bmatrix} - \begin{bmatrix} 1 & 0 & c_2 & 0 & 1 & 0 \\ 0 & m_1 & 0 & 1 & 0 & 1 \end{bmatrix} \hat{x} \right) \tag{26}$$

In this formulation, the first mode is chosen in "strain" coordinates and the second in "gyroscope" coordinates. As for the elevation axis, the coefficients of the observer gain matrix L are adapted for each lengths and inclination angle to provide a good reconstruction of the modes with sufficient attenuation of noise and disturbances. Due to the coupling of bending and torsional oscillations, a reduced gain matrix for the Luenberger observer can be chosen so that the first mode is estimated based on the strain gauges signals only, resulting in the following structure for the observer gain matrix:

$$L = \begin{bmatrix} * & * & * & * & * & * \\ 0 & 0 & * & * & * & * \end{bmatrix}^t \tag{27}$$

Therein, * denotes non-zero entries of the matrix and the superscript t the transpose of the matrix.

In an alternative implementation, the signals from the gyroscope axis $m_R$ can be used instead of the signals of the axis $m_T$. In this case, the parameters $c_i$ and $m_i$ in (26) must be chosen appropriately.

The model parameters contained in the dynamic equations of the Luenberger observer are taken from predetermined storage positions depending on the extraction lengths L of the boom and $L_{AA}$ of the articulated arm, and also on the inclination angle $\phi$ of the articulated arm and the cage payload (symbolized in FIG. 4 by item 85).

Figure 7:
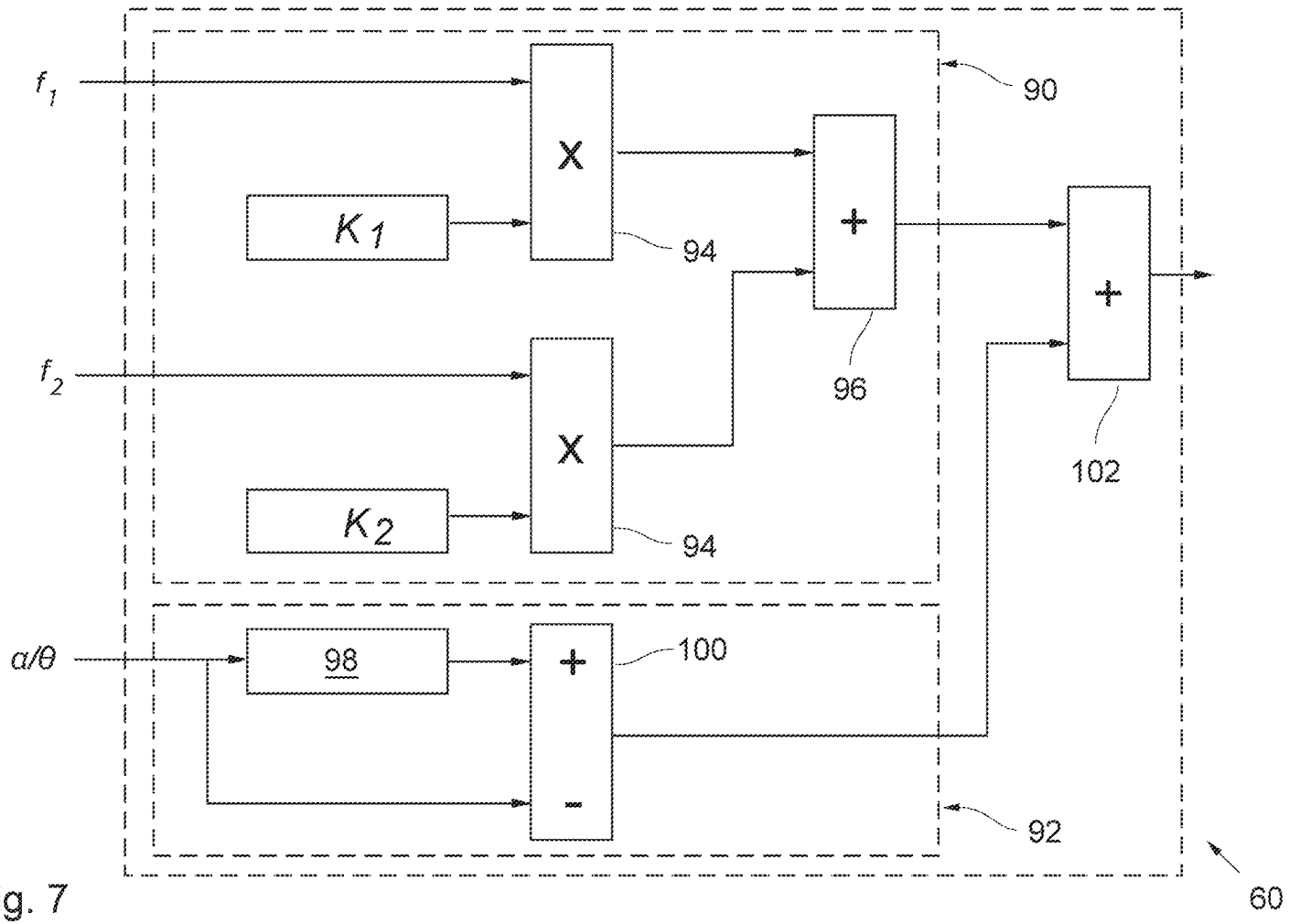
FIG. 7 is another detailed view of the control system of FIG. 4, demonstrating the calculation of the compensation angular velocity value.

The structure of the control module 60 is shown in FIG. 7. The control module 60 has generally two branches: namely an oscillation dampening branch 90 (upper part in FIG. 7) for processing the first oscillation mode $f_1$ and the second oscillation mode $f_2$, and a reference position control branch 92 for calculating a reference position control component, which will be explained in the following.

In the oscillation dampening branch 90, the first oscillation mode $f_1$ and the second oscillation mode $f_2$ reconstructed by the observer module 58 are taken, and each of these modes $f_1$ and $f_2$ is multiplied with a factor $K_i(L, L_{AA}, \phi)$, depending on the extraction lengths and the inclination angle. After this multiplication (in operation steps 94), the resulting signals are added in operation step 96, to obtain a resulting signal value, which is output from the dampening branch 90.

In the reference position control branch 92, the deviation of the present position (given by elevation angle $\alpha$ or rotation angle $\theta$, respectively) from a reference position (given in item 98) is calculated (in subtraction step 100), to result in the reference position control component output by the reference position control branch 92. Both the reference position control component and the signal value calculated by the oscillation dampening branch 90, are added in an addition step 102, to result in a compensation angular velocity value, to be output by the control module 60.

As shown in FIG. 4, the resulting compensation angular velocity value is added (item 104) within the drive control signal calculation branch 56 to an feedforward angular velocity value output by the feedforward branch 52, to calculate a drive control signal (position 106).

In the feedforward branch 52, a raw input signal derived from a manual input device or the like is input into a trajectory planning component 51. The reference angular velocity signal output by the trajectory planning component 51 is modified by a following dynamic oscillation cancelling component 53 to reduce the excitation of oscillations, which outputs the feedforward angular velocity value.

The invention claimed is:

1. A method for controlling an aerial apparatus comprising a telescopic boom (12), strain gauge (SG) sensors (18) for detecting the bending state of the telescopic boom (12) in a horizontal and a vertical direction, a gyroscope (16) attached to the top of the telescopic boom (12) and control means for controlling a movement of the aerial apparatus on the basis of signal values gained from the SG sensors and the gyroscope, said method comprising the following steps:

obtaining raw signals $SG_{Raw}$, $GY_{Raw}$ from the SG sensors (18) and the gyroscope (16), calculating reference signals from the raw signals $SG_{Raw}$, $GY_{Raw}$, including an SG reference signal $SG_{Ref}$, representing a strain value, and a gyroscope reference signal $GY_{Ref}$, representing an angular velocity value, and an angular acceleration reference signal $AA_{Ref}$ derived from angular position or angular velocity measurement values, reconstructing a first oscillation mode $f_1$ and at least one second oscillation mode $f_2$ of higher order than the first oscillation mode $f_1$ from the reference signals and additional model parameters PAR related to the construction of the aerial apparatus, calculating a compensation angular velocity value $AV_{Comp}$ from the reconstructed first oscillation mode $f_1$ and at least one second oscillation mode $f_2$, and adding the calculated compensation angular velocity value $AV_{Comp}$ to a feedforward angular velocity value to result in a drive control signal.

2. The method according to claim 1, characterized in that the calculation of the SG reference signal $SG_{Ref}$ includes:

calculating a strain value $V_{Strain}$ from a mean value of the raw signals $SG_{Raw}$ of SG sensors (18) measuring a vertical bending of the telescopic boom or a difference value of the raw signals $SG_{Raw}$ of SG sensors (18) measuring a horizontal bending of the telescopic boom (12), and high-pass filtering the strain value $V_{Strain}$.

3. The method according to claim 2, characterized in that the calculation of the SG reference signal $SG_{Ref}$ includes:

interpolating a strain offset value $V_{Off}$ from the elevation angle of the telescopic boom (12) and the extraction length of the telescopic boom (12), and correcting the strain value $V_{Strain}$ before high-pass filtering by subtracting the strain offset value $V_{Off}$ from the strain value $V_{Strain}$.

4. The method according to claim 3, characterized in that the interpolation of strain offset value $V_{Off}$ is further based on the extraction length of an articulated arm (14) attached to the end of the telescopic boom (12) and the inclination angle between the telescopic boom (12) and the articulated arm (14).

5. The method according to claim 3, characterized in that the interpolation of strain offset value $V_{Off}$ is further based on the mass of a cage attached to the end of the telescopic boom (12) or to the end of the articulated arm (14) and a payload within the cage.

6. The method according to claim 1, characterized in that the calculation of the gyroscope reference signal $GY_{Ref}$ includes:

calculating a backward difference quotient of the raw signal $GY_{Raw}$ from an angular position measurement to obtain a angular velocity estimate signal $V_{Est}$, filtering the angular velocity estimate signal $V_{Est}$ by a low pass filter, calculating the respective fraction of the filtered angular velocity estimate signal $V'_{Est}$ that is associated with each axis of the gyroscope, subtracting this fraction of the filtered angular velocity estimate signal $V'_{Est}$ from the original raw signal $GY_{Raw}$ from the gyroscope (16), to obtain a compensated gyroscope signal $GY_{Comp}$, and low-pass filtering the compensated gyroscope signal $GY_{Comp}$.

7. The method according to claim 1, characterized in that the calculation of the compensation angular velocity value $AV_{Comp}$ includes the addition of a reference position control component, which is related to a deviation of the present position from a reference position, to a signal value calculated from the reconstructed first oscillation mode $f_1$ and at least one second oscillation mode $f_2$.

8. The method according to claim 1, characterized in that the feedforward angular velocity value is obtained from a trajectory planning component (51) calculating a reference angular velocity signal based on a raw input signal, which is modified by a dynamic oscillation cancelling component (53) to reduce the excitation of oscillations.

9. An aerial apparatus, comprising a telescopic boom (12), strain gauge (SG) sensors (18) for detecting the bending state of the telescopic boom (12) in a horizontal and a vertical direction, a gyroscope (16) attached to the top of the telescopic boom (12) and control means for controlling a movement of the aerial apparatus on the basis of signal values gained from the SG sensors (18) and the gyroscope (16), wherein said control means implement the control method according to one of the preceding claims.

10. The aerial apparatus according to claim 9, characterized in that at least four SG sensors (18) are arranged in two pairs (22,24), each one pair being arranged on top and at the bottom of the cross section of the telescopic boom (12), respectively, with the two SG sensors of each pair being arranged at opposite sides of the telescopic boom (12).

11. The aerial apparatus according to claim 9, characterized in that the aerial apparatus further comprises an articulated arm (14) attached to the end of the telescopic boom (12).

12. The aerial apparatus according to claim 9, characterized in that the aerial apparatus further comprises a rescue cage attached to the end of the telescopic boom (12) or to the end of the articulated arm (14).

* * * * *